US009249538B2

(12) United States Patent
Bison et al.

(10) Patent No.: US 9,249,538 B2
(45) Date of Patent: Feb. 2, 2016

(54) LAUNDRY TREATMENT APPARATUS WITH HEAT PUMP

(71) Applicant: Electrolux Home Products Corporation N.V., Brussels (BE)

(72) Inventors: Alberto Bison, Pordenone (IT); Francesco Cavarretta, Pordenone (IT); Massimiliano Vignocchi, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 127 days.

(21) Appl. No.: 14/346,840

(22) PCT Filed: Sep. 26, 2012

(86) PCT No.: PCT/EP2012/068931

§ 371 (c)(1),
(2) Date: Mar. 24, 2014

(87) PCT Pub. No.: WO2013/045477

PCT Pub. Date: Apr. 4, 2013

(65) Prior Publication Data

US 2014/0223758 A1 Aug. 14, 2014

(30) Foreign Application Priority Data

Sep. 26, 2011 (EP) ..... 11182775

(51) Int. Cl.
*D06F 58/28* (2006.01)
*D06F 58/20* (2006.01)
*D06F 58/24* (2006.01)

(52) U.S. Cl.
CPC ..... *D06F 58/206* (2013.01); *D06F 58/24* (2013.01)

(58) Field of Classification Search
CPC ..... F26B 11/00; F26B 11/06; F26B 11/19; F26B 21/10; F26B 21/06; D06F 58/00; D06F 58/20; D06F 58/28
USPC ..... 34/595, 601, 606, 610; 68/5 C, 5 R, 19, 68/20; 8/149, 159
See application file for complete search history.

(56) References Cited

U.S. PATENT DOCUMENTS 7,020,985 B2 * 4/2006 Casey ..... D06F 58/206 34/595
7,191,543 B2 * 3/2007 Yakumaru ..... D06F 58/206 34/77

(Continued)

FOREIGN PATENT DOCUMENTS

BE EP 2573252 A1 * 3/2013 ..... D06F 58/206
BE EP 2586906 A1 * 5/2013 ..... D06F 58/206

(Continued)

OTHER PUBLICATIONS

International Search Report mailed Oct. 23, 2012 in corresponding International Application No. PCT/EP2012/068931.

(Continued)

*Primary Examiner* — Stephen M Gravini
(74) *Attorney, Agent, or Firm* — Banner & Witcoff, LTD.

(57) ABSTRACT

A laundry treatment apparatus, in particular a dryer (2*a*) or washing machine having a drying function, includes a cabinet having a front wall, a rear wall, side walls and a base section. The base section has an internal side facing the interior of the cabinet and an external side exposed to the outside of the cabinet. A laundry storing chamber for treating laundry using process air (A), a process air loop for circulating the process air through the laundry storing chamber, and a heat pump system for dehumidifying and heating the process air are also provided. The heat pump system has a refrigerant loop comprising: a first heat exchanger (10) for heating a refrigerant and cooling the process air (A), a second heat exchanger (12) for cooling the refrigerant and heating the process air, a refrigerant expansion device, a compressor, and an auxiliary heat exchanger (13). The auxiliary heat exchanger (13) is arranged at the external side of the base section.

18 Claims, 3 Drawing Sheets

(56) References Cited

U.S. PATENT DOCUMENTS

| | | | | |
|---|---|---|---|---|
| 7,347,009 | B2 * | 3/2008 | Ahn | D06F 58/24 34/607 |
| 7,908,766 | B2 * | 3/2011 | Ahn | D06F 58/206 126/21 A |
| 8,112,904 | B2 * | 2/2012 | Kono | D06F 25/00 34/201 |
| 8,356,423 | B2 * | 1/2013 | Corberan Salvador | D06F 58/22 165/158 |
| 8,387,273 | B2 * | 3/2013 | Driussi | D06F 58/206 165/11.1 |
| 8,572,862 | B2 * | 11/2013 | TeGrotenhuis | F26B 23/005 165/164 |
| 8,615,895 | B2 * | 12/2013 | Shin | D06F 58/22 34/606 |
| 8,650,770 | B1 * | 2/2014 | Levy | F26B 21/001 34/219 |
| 9,091,015 | B2 * | 7/2015 | Caldeira | D06F 58/206 |
| 9,097,462 | B2 * | 8/2015 | Lorenc | D06F 58/206 |
| 2010/0275457 | A1 * | 11/2010 | Balerdi Azpilicueta | D06F 58/24 34/86 |
| 2014/0223758 | A1 * | 8/2014 | Bison | D06F 58/206 34/86 |
| 2014/0290091 | A1 * | 10/2014 | Bison | D06F 58/206 34/524 |

FOREIGN PATENT DOCUMENTS

| | | | | |
|---|---|---|---|---|
| BE | EP 2573252 | B1 * | 5/2014 | D06F 58/206 |
| EP | 1884586 | | 2/2008 | |
| EP | 2034084 | | 3/2009 | |
| WO | 2008086933 | | 7/2008 | |
| WO | WO 2013045477 | A1 * | 4/2013 | D06F 58/206 |
| WO | WO 2013060452 | A1 * | 5/2013 | D06F 58/206 |

OTHER PUBLICATIONS

Extended European Search Report dated Mar. 14, 2012 in corresponding European Application No. 11182775.4.

* cited by examiner

Fig. 1
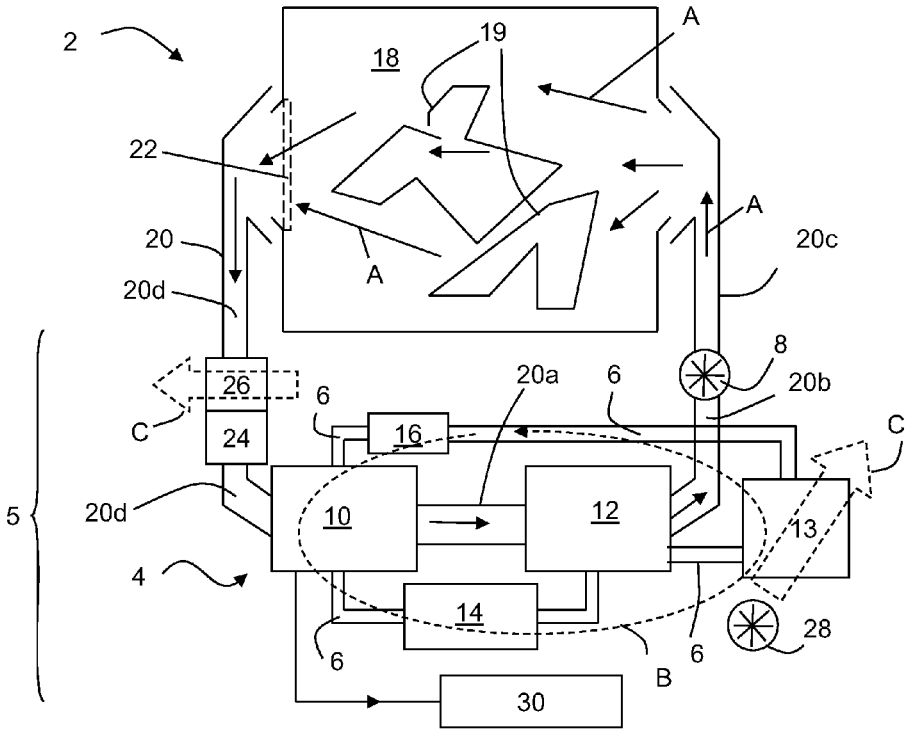
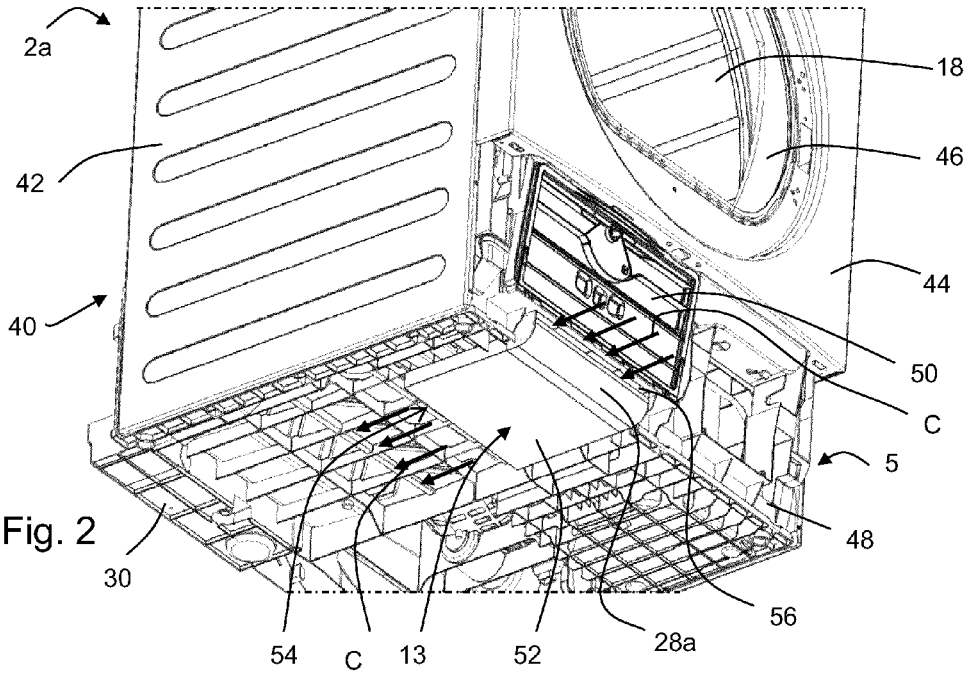
Fig. 2

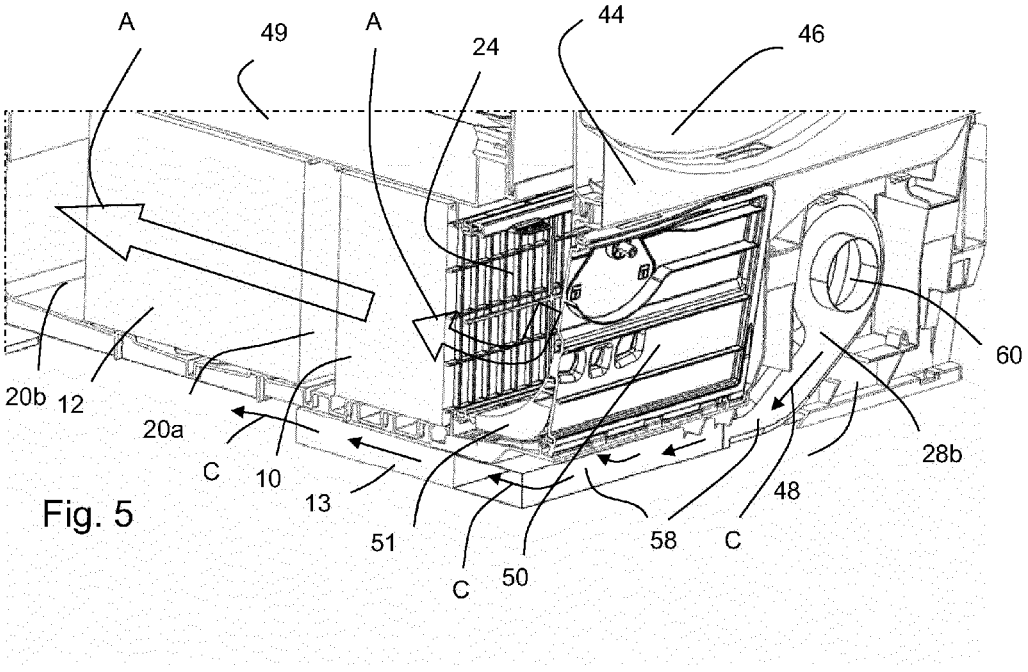
Fig. 5
Fig. 6
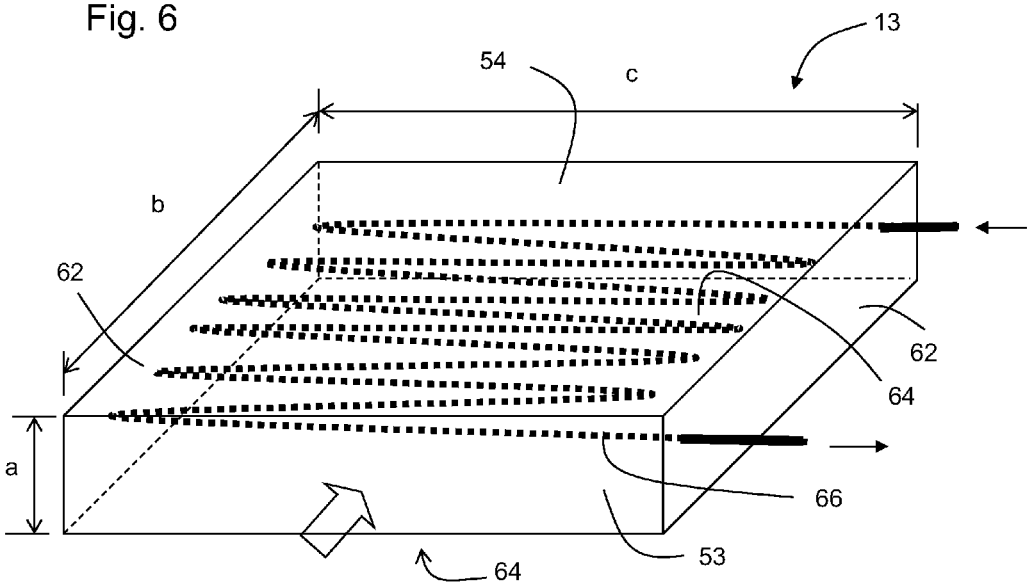

LAUNDRY TREATMENT APPARATUS WITH HEAT PUMP

BACKGROUND

The invention relates to a laundry treatment apparatus having a heat pump system in which process air for laundry treatment is dehumidified and heated.

In driers using a heat pump system for dehumidifying and heating the process air in a closed process air loop, excess energy has to be removed from the heat pump system as soon as the system has achieved a steady state of operation. The so called steady state is an optimum operation state in which the dehumidifying capacity of the evaporator and the heating capacity of the condenser are optimized in view of drying the laundry and energy consumption of the heat pump system. In the steady state the excess energy is the heat loss power introduced to the system by the compressor and which over the time would drive the system to an over-temperature and less-optimum operation, if not removed. From prior art different approaches are known to remove the excess energy when reaching the steady state.

A dryer having a heat pump system for dehumidifying and heating process air is known from WO 2008/086933 A. An auxiliary condenser cooled by ambient air is used to remove heat from the refrigerant loop in the heat pump system.

In the dryer of EP 2 034 084 A1 an auxiliary condenser of the heat pump system is arranged in the bottom section between an ambient air blower and a compressor such that the ambient air cools and removes excessive heat from both, the auxiliary condenser and the compressor.

SUMMARY OF SELECTED INVENTIVE ASPECTS

It is an object of the invention to provide a laundry treatment apparatus having a heat pump system in which an auxiliary heat exchanger is integrated in a compact manner.

According to an aspect of the invention, a laundry treatment apparatus having a laundry storing chamber for treating the laundry and a heat pump system for dehumidifying and heating process air vented through the laundry storing chamber is provided. For removing at least a portion of the excessive energy (i.e. excessive heat power or temperature) from the heat pump system, an auxiliary heat exchanger is provided which removes heat from the refrigerant circulated in the refrigerant loop. The auxiliary heat exchanger may function as an auxiliary condenser or as gas cooler in a transcritical or totally supercritical refrigerant cycling process. Preferably the heat is transferred from the refrigerant to ambient air which is available in the operating surroundings of the laundry treatment apparatus.

The laundry treatment apparatus has a cabinet comprising a front wall, a rear wall, side walls and a base section. The front wall may comprise a front top panel with an operation section and/or a front bottom panel providing an outer front cover of the base section. The cabinet defines the limit or limit region between the internal side of the apparatus and the external side of the apparatus. The base section representing or comprising a part of the cabinet thus also has an external side and an internal side with respect to the apparatus. In conventional laundry treatment apparatus having a heat pump system, like heat pump dryers or washing machines, all components of the apparatus—in particular the components of the heat pump system—are arranged in the internal side of the apparatus.

According to an aspect of the invention, the auxiliary heat exchanger is arranged at an external side of the base section. Preferably the heat pump system is arranged completely or substantially in a basement of the apparatus, preferably in the base section portion of the apparatus. Then providing the auxiliary heat exchanger in the base section results in the advantage that it is arranged close to other elements of the heat pump system. Preferably the auxiliary heat exchanger at the external side of the base section is arranged below or essentially below a vertical height level of the other components of the heat pump system or refrigerant loop. The other components of the heat pump system are a first and second heat exchanger, a compressor, and preferably an expansion device. The main components of the heat pump system or refrigerant loop are preferably arranged in or on a bottom shell forming part of the bottom base section of the apparatus, wherein the bottom shell preferably forms the lower cover or cabinet element of the apparatus.

By arranging the auxiliary heat exchanger in this way on the base section of the apparatus, a compact overall layout or design of the heat pump system can be provided. This can for example be used to provide the apparatus with smaller outer total dimension or to provide more internal space in the apparatus cabinet for other components, for example to enable a larger drum diameter in case of a laundry storing compartment of the apparatus being a rotatable drum.

The auxiliary heat exchanger may be connected in the refrigerant loop between the compressor and the second heat exchanger or between the second heat exchanger and the refrigerant expansion device. The first heat exchanger may operate as an evaporator or gas heater in a transcritical or totally supercritical refrigerant cycling process and the second heat exchanger may operate as a condenser or gas cooler in a transcritical or totally supercritical refrigerant cycling process.

In an embodiment the base section forms or comprises at the internal side thereof at least a portion of a battery channel. The battery channel is a section of the process air channel which houses or at least partially houses the first and second heat exchangers. Alternatively or additionally the base section supports the first and second heat exchangers and/or the compressor of the heat pump system.

Preferably the base section comprises a bottom shell that is forming the bottom cabinet part of the laundry treatment apparatus. The bottom shell may be formed by a monolithic part, preferably a single plastic mold part. In an embodiment thereof the base section further comprises a cover or upper shell which is covering at least some of the components of the heat pump system that are arranged or mounted in the bottom shell. For example the cover shell forms portion of the process air channel, in particular the portion of the process air channel forming a battery channel in which the first and second heat exchangers are arranged.

In a preferred embodiment the base section, in particular a bottom shell forming part of the base section, comprises a recess and/or a seat and/or mounting structure for receiving and/or fixing the auxiliary heat exchanger. The recess is arranged at the external side of the base section (bottom shell) for receiving the auxiliary heat exchanger completely or at least partially retracted from a protruded position at the outer face of the cabinet for mechanical protection of the auxiliary heat exchanger. By the mounting structure, which may comprise snap-fits, screwing holes and/or alignment elements, mounting the auxiliary heat exchanger is simplified.

In a preferred embodiment the base section, in particular a bottom shell forming part of the base section, comprises a channel section in which the auxiliary heat exchanger is at least partially arranged, so that the cooling air passes through the channel section.

Preferably a blower is provided to flow cooling air through the auxiliary heat exchanger. Preferably the blower is operated under the control of a control unit such that the start, the stop, the operation duration, the flow rate and/or the flow direction of the cooling air can be controlled. For example the cooling air flow is started only when a predefined refrigerant temperature and/or pressure is detected in the refrigerant loop. Actively driving the cooling air flow also provides the advantage to adapt the auxiliary heat exchanger design and the path of the cooling air according to the place and technical requirements related to location where the auxiliary heat exchanger is provided.

In an embodiment the blower is directly connected to the inlet or outlet of the auxiliary heat exchanger to have a compact design and/or the blower is arranged below a fluff filter compartment provided in the process air channel.

In an embodiment the blower and/or the auxiliary heat exchanger is arranged at an outside surface or side of the base section, preferably of the bottom shell, of the apparatus. Preferably the other components of the heat pump system are arranged inside or at an inner side of the base section or bottom shell. More preferably the blower and/or auxiliary heat exchanger are mounted in respective receiving recess(es) or compartment(s) of the base section or bottom shell. For example the bottom shell provides outside supporting structure and/or portions of side walls or of the case of the blower and/or auxiliary heat exchanger. Thereby a cost efficient assembly structure is implemented. Preferably the outer maximum dimensions are not extended by providing the blower and/or auxiliary heat exchanger in or at the outside recess(es) or compartment(s).

When the blower is arranged laterally or vertically downward or upward offset to the auxiliary heat exchanger, preferably a cooling air guiding element or means is provided that guides the cooling air pushed or sucked by the blower towards or from the auxiliary heat exchanger. The cooling air guiding element is or comprises for example one or more of: a channel, a deflector, a fin, a nozzle, a baffle or a combination thereof. By the air guiding means (element) the efficiency of heat exchange of the blown cooling air is increased. The air guiding means preferably is adapted to concentrate the air flow to the surface of the auxiliary heat exchanger and/or to evenly distribute it over the (inlet or outlet) area of the auxiliary heat exchanger. Preferably the air guiding means is portion of a or the bottom shell and/or cover shell of the apparatus base section. Thus a double function is provided by the air guiding means.

Preferably the inlet opening(s) of the auxiliary heat exchanger and/or blower are directed to the apparatus front and/or are arranged at the apparatus front to enable sucking in of ambient air. Additionally or alternatively the outlet opening(s) of the auxiliary heat exchanger and/or blower are directed to the apparatus back side and/or are arranged at the apparatus back side or bottom side, e.g. to prevent a circulation loop for the cooling air between cooling air inlet and outlet.

In an embodiment the cooling air conveyed by the blower is additionally passed over or through other components of the apparatus by directing it thereto or therefrom by cooling air guiding means, like a cooling air channel or partition or deflection walls or elements. Such components are for example: a drum drive motor, the compressor, and power electronics of the apparatus, like compressor and/or drum motor drive electronics.

Preferably the heat exchanging surface(s) of the auxiliary heat exchanger is(are) increased by using one or more thermally conductive elements like: a corrugated metal plate, a heat radiator element, a heat exchanger rip, a heat exchanger fin or combinations thereof. One or more of these may be provided on or at a surface being in contact with the cooling air (i.e. to the outside of the refrigerant piping).

The process air loop is preferably a closed loop in which the process air is continuously circulated through the laundry storing chamber. However it may also be provided that a (preferably smaller) portion of the process air is exhausted from the process air loop and fresh air (e.g. ambient air) is taken into the process air loop to replace the exhausted process air. And/or the process air loop is temporally opened (preferably only a short section of the total processing time) to have an open loop discharge—which e.g. may be used to remove smell from the laundry treated.

In an embodiment a process air heat exchanger is provided for pre-cooling or additionally cooling the process air circulated in the process air loop. The process air heat exchanger exchanges heat between the process air and ambient air (air/air heat exchanger). Preferably the process air heat exchanger is arranged in, at or forms a portion of a process air channel unit, e.g. of the front channel, more specifically a filter compartment. The channel section unit represents a section or portion of the process air loop and is preferably a section that is normally not specifically provided to place or arrange the process air heat exchanger, but it is a section which would also provided, if the heat pump system is designed without the process air heat exchanger. I.e. the process air heat exchanger does not require extra design and/or extra components to integrate the process air heat exchanger within the process air loop.

Preferably the blower for providing cooling air for the auxiliary heat exchanger is also blowing cooling air to the process air heat exchanger. The common blower may provide the cooling air in parallel to the auxiliary and process air heat exchangers or first to the process air heat exchanger and then to the auxiliary heat exchanger or vice versa. The blower may be arranged between the auxiliary and process air heat exchanger or downstream (sucking cooling air) or upstream (blowing cooling air) to them.

Preferably the process air heat exchanger is arranged close to and/or upstream the first heat exchanger and downstream the laundry storing chamber. Thereby the heat exchanging efficiency and the efficiency of the heat pump system is optimized in that heat energy is removed from the process air in a hot and high humid state and a pre-cooling for the first heat exchanger is provided. On the other hand by the close proximity to the first heat exchanger, condensate that forms in the process air heat exchanger can be guided or discharged to the condensate collection device provided for the first heat exchanger.

In a preferred embodiment the channel section unit where the process air heater is arranged or housed is a fluff filter unit and/or is a service access unit of the apparatus. The fluff filter unit is for example provided in the base of the apparatus, preferably accessible from the front of the apparatus, and has a fluff filter which removes lint from the process air before it enters the first heat exchanger. Integration of the process air heat exchanger to the fluff filter unit means a minimum of adaptation and minimum change of the apparatus and can thus be implemented cost effective. The same applies in case the channel section unit is a service access unit that is used to maintain, clean or service components of the apparatus. For example the service access unit provides an access from outside of the apparatus cabinet to the interior of the process air loop, e.g. an opening in the cabinet and/or the process air channel for cleaning and/or removing heat exchanger fins of the first and/or second heat exchanger.

According to an embodiment, the vertical dimension a of the auxiliary heat exchanger is smaller than one of the horizontal dimensions b, c of the auxiliary heat exchanger or is smaller than any of the horizontal dimensions b, c of the auxiliary heat exchanger, or the area of the cooling air inlet and/or the area of the cooling air outlet of the auxiliary heat exchanger is smaller than at least one side area b×c of the auxiliary heat exchanger which is oriented parallel or essentially parallel to the main flow path C of the cooling air through the auxiliary heat exchanger. In an alternative or additional embodiment the ratio of vertical dimension a to the largest horizontal dimension c of the auxiliary heat exchanger is less than or approximately 1:2, 1:3, 1:5, 1:8, or 1:10. In an alternative or additional embodiment the length b of the cooling air flow path C through the auxiliary heat exchanger is larger than the minimum dimension a of the cross section area a×c perpendicular to the cooling air flow path through the auxiliary heat exchanger.

Thus the auxiliary heat exchanger has a 'flat' design and the cooling air is flown in and exhausted out at a 'flat' side or edge, respectively. Flat means for example that the area of the cooling air inlet and outlet (in particular the cross section area of the auxiliary heat exchanger in a sectional plane perpendicular to the cooling air flow path through the auxiliary heat exchanger) is smaller than the cross section area of the auxiliary heat exchanger along a main axis (i.e. the largest cross section area of a sectional plane parallel to the cooling air flow path). As a result, the cross sections of air channels (as far as applicable) for guiding cooling air from and to the auxiliary heat exchanger and a blower for blowing the cooling air is smaller as compared to conventional auxiliary heat exchangers. Thus the overall space or volume requirement for integrating the auxiliary heat exchanger in the apparatus is significantly reduced.

The cooling capacity of the auxiliary heat exchanger is not provided by a large cross section for passing the cooling air, but by an extended cooling air path length through the auxiliary heat exchanger. Preferably the cooling air path length through the auxiliary heat exchanger is longer than at least the shortest inlet or outlet cross section dimension. Preferable ratios for the auxiliary heat exchanger dimension are set out in dependent claims or in the below detailed description which are applicable for the auxiliary heat exchanger of the invention in general.

Due to the flat design, the auxiliary heat exchanger can be sandwiched between other components or elements of the apparatus or at the bottom gap between the outer surface of a bottom shell and the floor on which the apparatus is placed. Or between a process air channel wall and the inside wall section of the apparatus cabinet (e.g. bottom shell thereof). For example the auxiliary heat exchanger is arranged below a section of the process air channel in the bottom shell of the apparatus. The process air channel preferably houses a filter compartment and/or the battery (the first and second heat exchangers) and is inclined in process air flow direction to drain condensate formed at the first heat exchanger towards a condensate collection reservoir. Due to the inclined ramp, at the inlet side of the battery (and the filter compartment) section of the process air channel there is a wider gap between the channel bottom side and apparatus location floor upper side where the 'flat' auxiliary heat exchanger can be conveniently arranged.

BRIEF DESCRIPTION OF THE DRAWINGS

Reference is made in detail to preferred embodiments of the invention, examples of which are illustrated in the accompanying figures, which show:

FIG. 1 a schematic view of a dryer with a heat pump system,

FIG. 2 a perspective bottom view to a dryer having an auxiliary heat exchanger integrated in a base unit, FIG. 3 the base unit of FIG. 2 in cross section showing process and cooling air flow, FIG. 4 a perspective bottom view to a dryer having an auxiliary heat exchanger integrated in a base unit according to another embodiment, FIG. 5 the base unit of FIG. 4 in cross section showing process and cooling air flow, and FIG. 6 a principal scheme of auxiliary heat exchanger dimensions.

DETAILED DESCRIPTION OF EXAMPLE EMBODIMENTS

Figure 3:
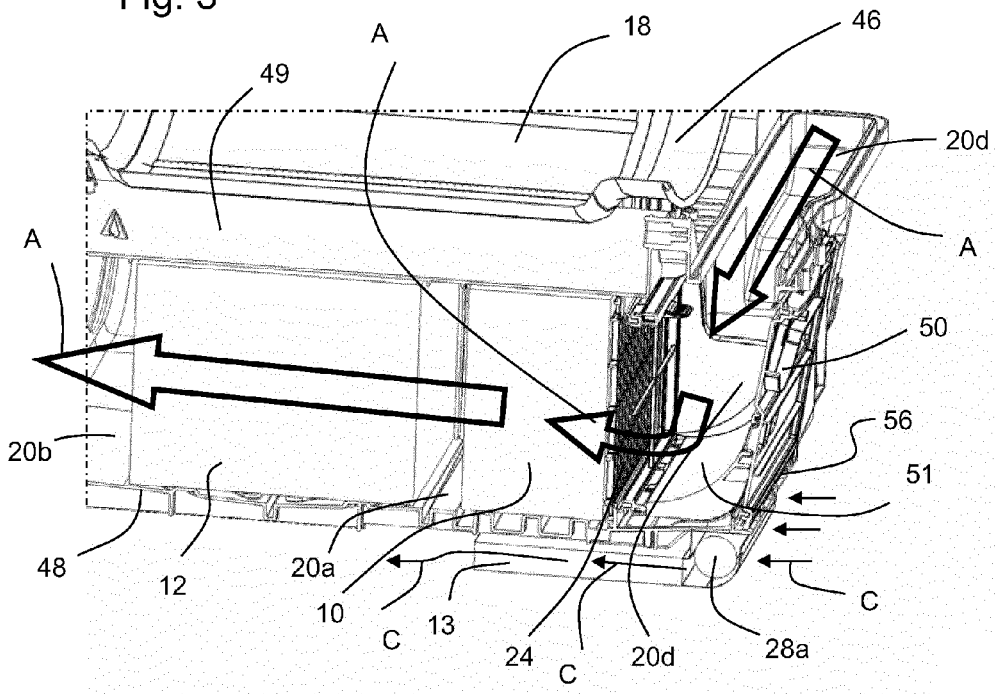

FIG. 1 depicts in a schematic representation a home appliance 2 which in this embodiment is a heat pump tumble dryer. The tumble dryer comprises a heat pump system 4, including in a closed refrigerant loop in this order of refrigerant flow B: a first heat exchanger 10 acting as evaporator for evaporating the refrigerant and cooling process air, a compressor 14, a second heat exchanger 12 acting as condenser for cooling the refrigerant and heating the process air, an auxiliary heat exchanger 13 acting as auxiliary condenser and transferring heat to cooling air, and an expansion device 16 from where the refrigerant is returned to the first heat exchanger 10. Together with the refrigerant pipes connecting the components of the heat pump system 4 in series, the heat pump system forms a refrigerant loop 6 through which the refrigerant is circulated by the compressor 14 as indicated by arrow B. If the refrigerant in the heat pump system is operated in the transcritical or totally supercritical state, the first heat exchanger 10 can act as gas heater and the second and auxiliary heat exchanger 12, 13 can act as gas cooler. The main components of the heat pump system 4 are arranged in a base section 5 or basement of the dryer 2, different embodiments of which are shown in the following figures.

The expansion device 16 is a controllable valve that operates under the control of a control unit to adapt the flow resistance for the refrigerant in dependency of operating states of the heat pump system 4. In alternative embodiments the expansion device 16 can be a capillary tube, a valve with fixed expansion cross-section, a throttle valve with variable cross section that automatically adapts the expansion cross-section in dependency of the refrigerant pressure (e.g. by elastic or spring biasing), a semi-automatic throttle valve in which the expansion cross-section is adapted in dependency of the temperature of the refrigerant (e.g. by actuation of a thermostat and/or where the temperature of the refrigerant is taken at a predefined one of the components, in thermal contact with the refrigerant.

The process air flow within the home appliance 2 is guided through a compartment 18 of the home appliance 2, i.e. through a compartment 18 for receiving articles to be treated, e.g. a drum 18. The articles to be treated are textiles, laundry 19, clothes, shoes or the like. In the embodiments here these are preferably textiles, laundry or clothes. The process air flow is indicated by arrows A in the Figures and is driven by a process air blower 8. The process air channel 20 guides the process air flow A outside the drum 18 and includes different sections, including the section forming the battery channel 20*a* in which the first and second heat exchangers 10, 12 are arranged. The process air exiting the second heat exchanger 12 flows into a rear channel 20*b* in which the process air blower 8 is arranged. The air conveyed by blower 8 is guided upward in a rising channel 20*c* to the backside of the drum 18. The air exiting the drum 18 through the drum outlet (which is the loading opening 46 of the drum) is filtered by a first fluff filter 22 arranged close to the drum outlet in or at a front channel 20*d*. Then the process air flows through a second fluff filter 24 arranged close to the first heat exchanger 10. The first and second fluff filters 22, 24 are arranged in the front channel 20*d* forming another section of channel 20 which is arranged behind and adjacent the front cover of the dryer 2. Optionally the front channel 20*d* further houses and/or is partially formed by an air/air heat exchanger 26 which is at least partially arranged in a fluff filter compartment of channel 20*d*. The fluff filter compartment houses the second fluff filter 24 and is covered by a filter door 50 shown in the following figures.

During operation of the dryer 2, the auxiliary heat exchanger 13 transfers heat from the process air to ambient air, which is also denoted as cooling air C in the following. By transferring heat to the cooling air, during a steady state of operation of the heat pump system 4, excess heat is removed from the heat-exchanging closed loops of the process air loop and refrigerant loop 6. Thereby the electrical power consumed by the compressor 14 and which is not transformed to work power by compressing the refrigerant, i.e. loss heat power of the compressor, is removed from the—under ideal consideration—closed loops of refrigerant and process air. This means that in the steady state of heat pump system operation, in which maximum or nearly maximum operation condition or efficiency is achieved after the warm-up period, the heat deposited by the compressor in the refrigerant loop 6 has to be removed by the auxiliary heat exchanger 13 to prevent overheating. Optionally and additionally the above mentioned air/air heat exchanger 26 is provided for pre-cooling the process air before entering the first heat exchanger 10. The cooling air conveyed by blower 28 through the auxiliary heat exchanger 13 can also be guided through or over the air/air heat exchanger 26 which may be arranged downstream or upstream of the auxiliary heat exchanger 13 and/or blower 28 with respect to the cooling air flow C.

According to the invention, the excess heat can be removed solely or exclusively using the auxiliary heat exchanger 13 as a heat sink for the excessive heat (not considering the non-ideal heat loss, like heat transfer from the drum or heat radiation at the refrigerant conducting components). The cooling air flow C, which is an ambient air flow in the embodiments, is taking heat from the heat exchanging surfaces of the auxiliary heat exchanger 13 (compare refrigerant piping 66 shown in FIG. 6). The blower 28 may blow the air to or suck the air from the auxiliary heat exchanger 13. In the following embodiments also reference numerals 28*a* and 28*b* are used for the blower conveying air flow C. The air flow C can be exclusively used to cool the auxiliary heat exchanger 13. However in an embodiment it may also be provided that downstream or upstream (with respect to the flow direction) the compressor 14 is cooled by the air flow C driven by blower 28. The air flow with respect to the compressor may be forward or backward, i.e. sucking from or blowing to the compressor. Preferably the blower 28 is operating as soon as the steady state is achieved or is approached. Preferably the blower operates continuously when steady state once has been achieved or is approached during the running drying cycle. Or the blower is operated according to cooling needs interruptedly or with varying conveyance speed.

The auxiliary heat exchanger 13 acting as additional condenser (or gas cooler in case of transcritical or totally supercritical operation of the refrigerant cycle) is connected in the refrigerant loop as indicated by refrigerant piping 6 in FIG. 1. In embodiments not shown, the sequence of the components in the refrigerant loop 6 can be modified in that the auxiliary heat exchanger 34 is not placed between the second heat exchanger 12 and the expansion device 16 with respect to refrigerant flow, but between the compressor 14 and the second heat exchanger 12. This modification is applicable to all embodiments herein.

At least when the heat pump system 4 is operating in the steady state (i.e. normal mode after the warm-up period, i.e. after starting the heat pump system 4 from low refrigerant pressure and low temperature state), the first heat exchanger 10 transfers heat from the process air A to the refrigerant. By cooling the process air to lower temperatures, humidity from the process air condenses at the first heat exchanger 10, is collected there and the collected condensate is drained to a condensate collector 30. The process air cooled and dehumidified when passing the first heat exchanger passes then through the second heat exchanger 12 where heat is transferred from the refrigerant to the process air. The process air is sucked from exchanger 12 by the blower 8 and is driven into the drum 18 where it heats up the laundry 19 and receives the humidity therefrom. The process air exits the drum 18 and is guided in front channel 20*d* back to the first heat exchanger 10.

FIG. 2 shows a perspective bottom view to the dryer base section 5 forming the bottom part of a dryer cabinet 40 for a first embodiment dryer 2*a*. The main components of the heat pump system 4 (except the control electronics which is arranged at a top section of dryer) are arranged in a bottom shell 48 which also forms parts of the process air channel 20, including the battery channel 20*a* (in which the first and second heat exchanger 10, 12 are encased), the rear channel 20*b*, portion of the rising channel (not shown) and portion of the front channel 20*d*. Further the cabinet is formed by two side covers (only one cabinet side wall 42 shown), a front cabinet wall 44 (partially shown) and a cabinet top cover (not shown). In FIGS. 2 to 5 the loading opening 46 in the front cabinet wall 44 for loading laundry into and out of drum 18 is shown. At the dryer base a front bottom panel, that normally covers the filter door 50, the front of bottom shell 48 and has cooling air inlet openings (to blower 28*a*, 28*b*), is removed in FIGS. 2 to 5.

As can be seen from the bottom perspective view, the auxiliary heat exchanger 13 is arranged below the filter compartment section of the front channel 20*d* and below portion of the battery channel 20*a* at the bottom side of the bottom shell 48. The auxiliary heat exchanger 13 has its cooling air inlet 60 (compare FIG. 6) towards the front side of the dryer 2*a* and cooling air outlet openings 54 towards the backside of the dryer. The cooling air exhausted from auxiliary heat exchanger 13 distributes in the gap between the bottom side of shell 48 and the ground floor where the dryer is located and flows from there mainly to the back side of the dryer. The auxiliary heat exchanger 13 is housed between a portion of the bottom wall of bottom shell 48 and a bottom cover 52 attached to the bottom wall of shell 48. Both define the outlines of the inlet 60 and the outlet 54 each with a corresponding cross section area. Inlet 60 and/or outlet 54 may have rips or a grid for stability and/or as protection cover. Depending on the flow direction of cooling air C, the function inlet/outlet can be reversed.

The blower outlet of tangential blower 28*a* is connected to the inlet 60 of the auxiliary heat exchanger 13 for blowing cooling air through exchanger 13. The blower 28*a* has air inlet openings 56 facing to the front of the dryer 2*a* for sucking in cooling air from the ambient at the front bottom side of the dryer. The inlet openings 56 are arranged below the filter door 50 and the blower 28*a* is arranged in a front bottom edge recess formed in the bottom shell 48. The auxiliary heat exchanger 13, i.e. its heat exchanging parts, is arranged in a respective exchanger recess or compartment at the outer side of the bottom shell 48.

FIG. 3 shows a perspective view to a partially cut out section of base 5 indicating the flow paths of the process air A and the cooling air C. The process air A comes down in the front channel 20*d* from the front opening and is laterally deflected in channel 20*d* into the filter compartment of channel 20*d*. In the filter compartment a filter drawer 51 is inserted that is supporting the second fluff filter 24 which is arranged in front of the first heat exchanger 10. The filter drawer 51 with the fluff filter 24 can be taken out of the filter compartment by the user after opening filter door 50 for removing fluff from the filter. The process air passes the filter 24 and then flows through the first and second heat exchangers 10, 12 in the battery channel 20*a*.

The cooling air flow C enters into tangential blower 28*a* through the openings 56. The openings 56 are formed in a grid which is integrated to the blower 28*a* which is attached to the outer side of the bottom shell 48 and is received in a respective outer recess of the bottom shell. The outlet of the blower is connected to the inlet opening 53 (FIG. 6) of the auxiliary heat exchanger 13 such that the cooling air is pushed by blower 28*a* through the cooling air passage of the auxiliary heat exchanger 13 where it exits through outlet openings 54. As mentioned above the cooling air flow direction may be reverted, for example by using a tangential blower 28*a* with respectively adapted housing and blower blades geometry.

Figure 4:
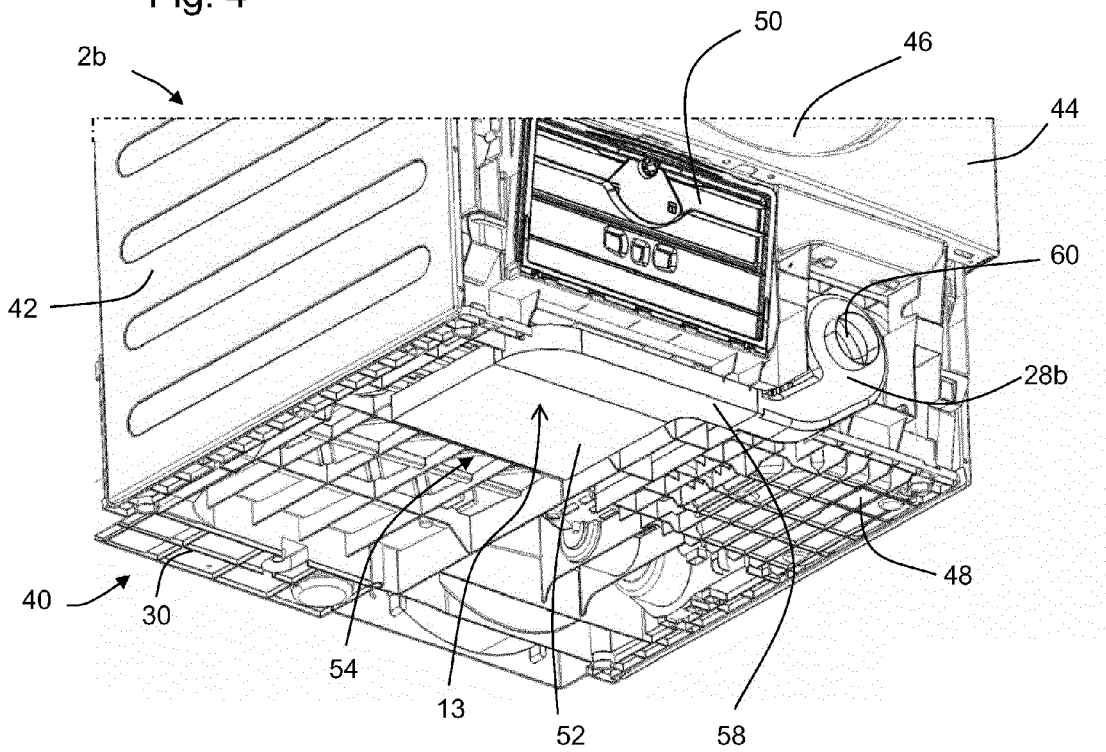

FIG. 4 shows another embodiment of a dryer 2*b* which is basically identical to the dryer 2*a* with the difference that the blower is not arranged in front and adjacent to the auxiliary heat exchanger 13, but a blower 28*b* is arranged laterally offset to the auxiliary heat exchanger 13 at the inside front region of the bottom shell 48. The blower 28*b* is a radial or centrifugal blower that blows the cooling air C into a cooling air channel 58. The cooling air channel 58 extends between the outlet of blower 28*b* and inlet 53 of the auxiliary heat exchanger 13 and passes from a front right region of the bottom shell 48 to the bottom left side of bottom shell. This means that the blower 28*ba* and part of the channel 58 is arranged at the inside of shell 48 (i.e. not at the outside of shell 48 (after mounting the not shown bottom front panel)) and part of the channel 58 is arranged at the bottom outer side of shell 48. In this embodiment the arrangement and details of the auxiliary heat exchanger 13 are identical to the one of the embodiment in FIGS. 2 and 3.

FIG. 5 is an enlarged view of FIG. 4 with partially cutout left portion, where the cross section is through the front and battery channels 20*d*, 20*a*, the channel 58 and auxiliary heat exchanger 13. The processing air flow A and the channels guiding it with the second fluff filter arrangement are as in FIGS. 2 and 3. The cooling air C is sucked in through openings in a front bottom panel (not shown) and an inlet opening 60 of blower 28*b*. The blower pushes the cooling air flow C through channel 58, inlet 53 and through the auxiliary heat exchanger 13 where it is exhausted through openings 54. Again the cooling air flow direction may be reverted and for this purpose the blower inlet 60 may be connected to the channel 58 or a tangential blower may be used instead of radial blower 28*b*.

FIG. 6 schematically depicts the auxiliary heat exchanger 13 and indicates its dimensions. The cooling air enters through the inlet 53 which has a cross section area perpendicular to the flow path. The cooling air exits through the outlet opening 54 which has a cross section area perpendicular to the flow path. The lateral side walls 62 may be formed of a wall structure of the bottom shell 48 or by side walls provided by the bottom cover 52 or the side walls 62 may be formed partially by a wall structure of shell 48 and of cover 52. The top cover 64 is preferably formed by the outer bottom wall of bottom shell 48 and the bottom cover is preferably provided by bottom cover 52. The walls define a volume in which the refrigerant piping 66 is arranged. The piping 66 may be provided with heat exchanger surfaces for enlarging the heat exchanging surface area, for example rips, heat radiators a grid structure or the like.

As compared to conventional heat exchangers and also as compared to the first and second heat exchangers 10, 12, the flow path length b (or depth) is larger than at least one (here a) exchanger dimension cross to the flow path C. The ratio between flow path length b to the height dimension a and/or width dimension c is or is at least e.g. 1.5, 2, 3, 4, 5, 6, 8 or 10. In particular the area of top and bottom sides 64 is larger than the area of the inlet 53 or outlet 54, preferably the ratio of top and/or bottom area to inlet and/or outlet area is or is at least 1.5, 2, 3, 4, 5, 6, 8 or 10. Thereby a 'flat' auxiliary heat exchanger 13 is provided that can be interlaced or inserted in gaps between elements, at wall niches or the like. Of course in embodiments the auxiliary heat exchanger 13 can be oriented to have the inlet 53 and outlet 54 in a vertical plane (as in the Figures), but with the longer dimension c oriented vertically and the shorter dimension a oriented horizontally. Or the inlet 53 and outlet 54 may be in a horizontal plane or being inclined with respect to the horizontal and/or a vertical plane. For example in an embodiment the auxiliary heat exchanger may be arranged between the battery channel 20*a* and the outer cabinet wall (e.g. in FIGS. 2 and 4 the left side cabinet wall 42), wherein cooling air is sucked in by blower (arranged e.g. at inlet 53 similar to the arrangement of elements 13/28*a*) through lateral openings in the front of bottom shell 48 and exhaust the cooling air through openings in the rear of bottom shell 48. Or it may be arranged flat on the top of cover shell 49 partially shown in FIG. 5. As compared to conventional auxiliary heat exchangers, the auxiliary heat exchanger 13 according to the invention has a small area requirement for the cooling air cross section and provides more freedom of design for integrating it even in narrow spaced dryer inside locations or outside gaps or recesses.

Individual components or group of components shown and described for the above embodiments can be combined among each other in any convenient way.

REFERENCE NUMERAL LIST

| | |
|---|---|
| 2, 2a, 2b | tumble dryer |
| 4 | heat pump system |
| 5 | base section |
| 6 | refrigerant loop |
| 8 | blower |
| 10 | first heat exchanger (evaporator) |
| 12 | second heat exchanger (condenser) |
| 13 | auxiliary heat exchanger (auxiliary condenser) |

-continued

| | |
|---|---|
| 14 | compressor |
| 16 | expansion device |
| 18 | drum (laundry compartment) |
| 19 | laundry |
| 20 | process air channel |
| 20a | battery channel |
| 20b | rear channel |
| 20c | rising channel |
| 20d | front channel |
| 22 | first fluff filter |
| 24 | second fluff filter |
| 26 | air/air heat exchanger |
| 28, 28a, 28b | blower |
| 30 | condensate collector |
| 40 | cabinet |
| 42 | side cabinet wall |
| 44 | front cabinet wall |
| 46 | loading opening |
| 48 | bottom shell |
| 49 | cover shell |
| 50 | filter door |
| 51 | filter drawer |
| 52 | bottom cover |
| 53 | inlet opening (area) |
| 54 | outlet opening (area) |
| 56 | inlet opening |
| 58 | cooling air channel |
| 60 | inlet (area) |
| 62 | side wall (area) |
| 64 | top/bottom wall (area) |
| 66 | refrigerant piping |
| A | process air flow |
| B | refrigerant flow |
| C | cooling air flow |
| a, b, c | outer dimensions of auxiliary heat exchanger |

The invention claimed is:

1. A laundry treatment apparatus having a drying function, comprising:

a cabinet having a front wall, a rear wall, side walls and a base section, wherein the base section comprises an internal side facing the interior of the cabinet and an external side exposed to the outside of the cabinet, a laundry storing chamber arranged inside the cabinet for treating laundry using process air, a process air loop for circulating the process air through the laundry storing chamber, and a heat pump system for dehumidifying and heating the process air, the heat pump system having a refrigerant loop comprising:

a first heat exchanger for heating a refrigerant and cooling the process air, a second heat exchanger for cooling the refrigerant and heating the process air, a refrigerant expansion device, a compressor, and an auxiliary heat exchanger;

wherein, the auxiliary heat exchanger is arranged at the external side of the base section.

2. An apparatus according to claim 1, wherein the base section forms, at the internal side, at least a portion of a battery channel of the process air loop for housing the first heat exchanger and the second heat exchanger.

3. An apparatus according to claim 1, wherein the internal side of the base section supports the first heat exchanger and the second heat exchanger.

4. An apparatus according to claim 1, wherein the internal side of the base section forms a seat for the compressor.

5. An apparatus according to claim 1, wherein the external side of the base section comprises a recess and/or mounting structure for receiving the auxiliary heat exchanger.

6. An apparatus according to claim 1, wherein the base section comprises a bottom shell and a cover shell forming together the battery channel, wherein the auxiliary heat exchanger is arranged at the bottom shell.

7. An apparatus according to claim 1, comprising a blower for blowing or sucking cooling air through the auxiliary heat exchanger.

8. An apparatus according to claim 7, wherein the blower is arranged at the bottom of the base section or at the external side of the base section at or in close proximity to the cooling air inlet or outlet of the auxiliary heat exchanger.

9. An apparatus according to claim 7, wherein the blower is arranged below a channel section unit of the process air loop.

10. An apparatus according to claim 7, wherein the blower is arranged in the base section or a bottom shell of the base section laterally offset to the auxiliary heat exchanger and an air guiding means is provided to guide the air from the blower to the auxiliary heat exchanger or from the auxiliary heat exchanger to the blower.

11. An apparatus according to claim 10, wherein the air guiding means is a channel extending from a first side front region in the base section or bottom shell to a second side front region at the bottom side of the cabinet.

12. An apparatus according to claim 7, wherein the blower is a radial blower or tangential blower.

13. An apparatus according to claim 7, wherein the blower sucks in or blows out the cooling air through at least one opening in the front wall of the apparatus or through openings in a front bottom panel of the cabinet.

14. An apparatus according to claim 7, wherein the blower sucks in or blows out the cooling air through at least one opening at the bottom side of the cabinet or at the back side of the cabinet or at least one opening to the inner side of the cabinet.

15. An apparatus according to claim 14, wherein the apparatus cabinet has ventilation openings at a bottom shell, at the cabinet side wall or at the cabinet rear wall.

16. An apparatus according to claim 1, comprising guiding means for guiding the cooling air from the auxiliary heat exchanger to one or more of the following or from one or more of the following to the auxiliary heat exchanger: the compressor, a drum drive motor of the apparatus and power electronics of the apparatus.

17. An apparatus according to claim 1, comprising a process air heat exchanger, wherein the process air heat exchanger is at least partially integrated in or is part of a channel section unit arranged in the base section or a bottom shell of the apparatus, wherein the channel section unit forms part of a process air channel section of the process air loop, and wherein the process air heat exchanger is adapted to exchange heat between the process air and the cooling air.

18. An apparatus according to claim 17, wherein the blower additionally blows the cooling air to the process air heat exchanger or sucks it from the process air heat exchanger.

* * * * *